US008662325B2

(12) United States Patent
Davis et al.

(10) Patent No.: US 8,662,325 B2
(45) Date of Patent: Mar. 4, 2014

(54) SHELVING GLIDE

(75) Inventors: Raymond E. Davis, Heath, TX (US); Clifton Glenn Hampton, Burleson, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 605 days.

(21) Appl. No.: 12/571,877

(22) Filed: Oct. 1, 2009

(65) Prior Publication Data

US 2010/0078402 A1 Apr. 1, 2010

Related U.S. Application Data

(60) Provisional application No. 61/101,910, filed on Oct. 1, 2008.

(51) Int. Cl.
*A47F 5/08* (2006.01)

(52) U.S. Cl.
USPC ..... 211/151; 211/184

(58) Field of Classification Search
USPC ..... 211/59.2, 59.3, 184, 175, 151, 153, 211/189–191; 108/60, 61
See application file for complete search history.

(56) References Cited

U.S. PATENT DOCUMENTS

| | | | | |
|---|---|---|---|---|
| 2,915,193 | A | | 12/1959 | Bromberg |
| 3,690,744 | A | | 9/1972 | Squire |
| D243,647 | S | | 3/1977 | Schoenfeld |
| D265,703 | S | | 8/1982 | Zaro |
| 4,678,247 | A | | 7/1987 | Pink |
| 5,082,125 | A | * | 1/1992 | Ninni ..... 211/184 |
| 5,115,920 | A | * | 5/1992 | Tipton et al. ..... 211/59.2 |
| 5,255,802 | A | | 10/1993 | Krinke et al. |
| 5,295,591 | A | * | 3/1994 | Slater ..... 211/59.2 |
| 5,341,945 | A | * | 8/1994 | Gibson ..... 211/184 |
| 5,593,048 | A | * | 1/1997 | Johnson ..... 211/59.2 |

(Continued)

FOREIGN PATENT DOCUMENTS

| | | |
|---|---|---|
| EP | 1106116 A1 | 6/2001 |
| WO | WO 99/30597 | 6/1999 |
| WO | WO 03/005862 A2 | 1/2003 |

OTHER PUBLICATIONS

Notification of Transmittal of the International Preliminary Report on Patentability (18 pages), mailed Feb. 10, 2011, for related international application PCT/US2009/059251.

(Continued)

*Primary Examiner* — Korie H Chan
(74) *Attorney, Agent, or Firm* — Fish & Richardson P.C.

(57) ABSTRACT

A shelving glide includes a deck having a plurality of dividers; a first trough having a first index arranged along at least a portion of a width of the deck; a second trough having a second index arranged along at least a portion of the width of the deck; and a plurality of partitions defining a plurality of pathways. A partition includes a first clip securable to the first index; and a second clip securable to the second index. The partition is adjustable along the width of the deck from a first position to a second position upon disengagement of the second clip from the second index. The first clip is adapted to disengage from the first index upon disengagement of the second clip from the second index. The partition is secured to the deck at the second position upon reengagement of the second clip to the second index.

26 Claims, 12 Drawing Sheets

(56) References Cited

U.S. PATENT DOCUMENTS

| | | | | |
|---|---|---|---|---|
| 5,673,801 | A * | 10/1997 | Markson | 211/59.3 |
| 5,884,782 | A * | 3/1999 | Dembicks | 211/70.6 |
| 6,089,385 | A * | 7/2000 | Nozawa | 211/59.2 |
| 6,105,798 | A * | 8/2000 | Gruber et al. | 211/151 |
| 6,523,664 | B2 * | 2/2003 | Shaw et al. | 193/35 R |
| 6,533,131 | B2 * | 3/2003 | Bada | 211/59.2 |
| 6,805,250 | B2 | 10/2004 | Ondrasik | |
| 7,114,606 | B2 * | 10/2006 | Shaw et al. | 193/35 R |
| 7,182,209 | B2 | 2/2007 | Squitieri | |
| 2001/0002659 | A1 | 6/2001 | Bada | |
| 2003/0010737 | A1 | 1/2003 | Lee | |
| 2005/0150847 | A1 | 7/2005 | Hawkinson | |
| 2006/0283819 | A1 | 12/2006 | Larsen et al. | |
| 2007/0175844 | A1 | 8/2007 | Schneider | |
| 2008/0017598 | A1 * | 1/2008 | Rataiczak et al. | 211/59.3 |

OTHER PUBLICATIONS

Notification of Transmittal of the International Search Report and the Written Opinion of the International Searching Authority, or Declaration (3 pages); International Search Report (4 pages); and Written Opinion of the International Searching Authority (9 pages), mailed Jan. 26, 2010, for related international application PCT/US2009/059251.

* cited by examiner

SHELVING GLIDE

CLAIM OF PRIORITY

This application claims priority under 35 U.S.C. §119(e) to U.S. Provisional Patent Application Ser. No. 61/101,910, filed on Oct. 1, 2008, the entire contents of which are hereby incorporated by reference.

TECHNICAL BACKGROUND

This disclosure relates to a shelving glide and, more particularly, to a shelving glide having one or more adjustable partitions.

BACKGROUND

Consumer products, such as drinks, food items, and other products, are often stored and displayed in shelving units. For example, consumer products may be stored and displayed on end caps located at one end of a longer shelving system. In addition, in such instances when the consumer products are perishable or require cold storage and/or display, the consumer products may be stored in large refrigerated rooms, or cooler vaults. Regardless of the storage and/or display location, vendors of consumer products often desire that the storage and/or display location allow for easy access to the products by the consumer. For instance, storage and/or display systems may utilize a dispenser glider, or "shelving glide," to present products to the consumer in sequential fashion. In some instances, however, the consumer products stored on the storage and/or display system may be of different sizes, different weights, and/or different shapes. Further, because consumer products such as food and drink containers may break or leak, the storage and/or display systems may often become contaminated with organic material, which can promote bacterial growth, mold, or other undesirable effects.

SUMMARY

In one embodiment, a shelving glide includes a deck having a plurality of dividers; a first trough coupled to the deck and having a first index arranged along at least a portion of a width of the deck; a second trough coupled to the deck and having a second index arranged along at least a portion of the width of the deck; and a plurality of partitions coupled to the deck and defining a plurality of pathways. At least one of the plurality of partitions includes a first clip securable to the first index; and a second clip securable to the second index. The partition is adjustable along the width of the deck from a first position to a second position different than the first position upon disengagement of the second clip from the second index. The first clip is adapted to disengage from the first index upon disengagement of the second clip from the second index. The partition is secured to the deck at the second position upon reengagement of the second clip to the second index.

In another embodiment, a method for presenting consumer products includes providing a shelving glide. The shelving glide includes a deck having a plurality of dividers; a first trough coupled to the deck and having a first index arranged along at least a portion of a width of the deck; a second trough coupled to the deck and having a second index arranged along at least a portion of the width of the deck; and a plurality of partitions coupled to the deck and defining a plurality of pathways, where at least one of the plurality of partitions includes a first clip coupled to the partition at a first end of the partition and a second clip coupled to the partition at a second end of the partition opposite the first end. The method also includes disengaging the second clip from the second index; adjusting the partition along the width of the deck from a first position to a second position different from the first position; and reengaging the second clip to the second index.

In another embodiment, a product vessel support device includes a frame including a plurality of channels extending between two opposed edges of the frame, each channel having a plurality of support rollers disposed within the channel; and a plurality of vertical dividers detachably secured to the frame. Each pair of adjacent vertical dividers define a corresponding vessel pathway above one or more channels. At least one of the plurality of vertical dividers is adjustable along the opposed edges of the frame between a first position and a second position. The at least one vertical divider is adapted to slidingly move between the first and second positions in response to a force applied to the vertical divider at a substantially single location. At least a portion of the vertical divider is coupled to the deck during sliding movement between the first and second positions.

In one aspect of one or more embodiments, the first clip may be adapted to reengage the first index upon reengagement of the second clip to the second index.

In one aspect of one or more embodiments, the dividers may define a plurality of channels, and the shelving glide may further include a plurality of rollers seated within the channels, where the rollers are adapted to rotate within the channels and support at least a portion of a container.

In one aspect of one or more embodiments, the shelving glide may further include a plurality of roller trays removably arranged within the plurality of channels, where the plurality of rollers are seated on the plurality of roller trays.

In one aspect of one or more embodiments, a portion of the plurality of rollers may be seated on one of the plurality of roller trays, where the portion of rollers and the roller tray define a ductway adapted to direct a fluid within the deck.

In one aspect of one or more embodiments, the shelving glide further includes a stage coupled to the deck, where the stage is adapted to support a plurality of containers.

In one aspect of one or more embodiments, the stage may be coupled to the second trough through a flanged connection.

In one aspect of one or more embodiments, the first clip may include one or more cleats adapted to be secured within corresponding notches of the first index; and a shoulder portion engageable within a recessed portion of the front trough.

In one aspect of one or more embodiments, the partition may be adapted to move along the width of the deck upon sliding movement of the first clip within the recessed portion of the front trough.

In one aspect of one or more embodiments, the notches may be disposed substantially vertically within a recessed portion of the first trough.

In one aspect of one or more embodiments, the second clip may include one or more prongs extending from the second clip, where at least one prong is engageable with one of a plurality of grooves in the second index.

In one aspect of one or more embodiments, at least one of the plurality of partitions may include a flared base portion extending from a substantially vertical wall portion, where the flared base portion is adapted to extend under at least a portion of a container.

In one aspect of one or more embodiments, the shelving glide may further include a plurality of container stops, where at least one of the container stops is attachable to a vertical edge of one of the plurality of partitions. The container stop may have a first wing portion extending across a first pathway and a second wing portion extending across a second pathway. The container stop may be substantially opaque.

In one aspect of one or more embodiments, disengaging the second clip from the second index includes lifting the second end of the partition to disengage the second clip from one or more grooves in the second index.

In one aspect of one or more embodiments, the first clip may include one or more cleats, where at least one cleat is adapted to be secured within one of a plurality of notches in the first index, and a shoulder portion engageable within a recessed portion of the front trough. Adjusting the partition along the width of the deck from a first position to a second position includes rotating the partition about a pivot proximate the first end of the partition to disengage the one or more cleats from corresponding one or more notches; sliding the partition from the first position to the second position, the shoulder sliding within the recessed portion; and reengaging the second clip to the one or more grooves in the second index.

In one aspect of one or more embodiments, reengaging the second clip to the one or more grooves in the second index includes reengaging the one or more cleats in the corresponding one or more notches of the first index.

In one aspect of one or more embodiments, at least one product container may be inserted into one of the plurality of pathways.

In one aspect of one or more embodiments, inserting at least one product container into one of the plurality of pathways includes loading a plurality of product containers on the stage; inserting a first product container from the stage into the pathway; inserting a second product container from the stage into the pathway; and inserting a third product container from the stage into another of the plurality of pathways.

In one aspect of one or more embodiments, adjusting the partition along the width of the deck from a first position to a second position includes adjusting the partition along the width of the deck from a first position to a second position with human contact of only the partition at or adjacent the second end of the partition.

In one aspect of one or more embodiments, the vertical divider may be secured to the frame adjacent a front edge by a front clip and secured to the frame adjacent a back edge by a back clip.

In one aspect of one or more embodiments, the vertical divider may be adapted to slidingly move between the first and second positions upon disengagement of the back clip from the frame and at least partial engagement of the front clip with the frame.

In one aspect of one or more embodiments, at least one of the plurality of vertical dividers includes a flared base portion adjacent a portion of the plurality of rollers.

In one aspect of one or more embodiments, the product vessel support device may further include at least one vessel stop coupled to one of the vertical dividers, where the stop has a first wing portion extending across a first vessel pathway and a second wing portion extending across a second vessel pathway adjacent the first vessel pathway.

Various embodiments of a shelving glide according to the present disclosure may include one or more of the following features. For example, the shelving glide may provide for a reduction of a total stack weight of multiple consumer products (e.g., food and/or drink containers or otherwise), thereby aiding in the removal of a single, front product by a customer and reducing gravity impact of the stack weight against a front stop after the product is removed. The shelving glide may also provide for less clearance between shelves within a shelving system. Thus, the shelving glide may allow for more volume of displayed consumer product in a given area. The shelving glide may also allow for maximum container display visibility. In addition, the shelving glide may provide for current and future shelving dimensional requirements. In other words, the shelving glide may provide for easy modifications to fit most storage and/or display applications. In addition, the shelving glide may provide for easier and faster change-outs of consumer products having substantially different dimensions, shapes, and/or weights without special tools or removal from a shelving system. The shelving glide may allow for adjustable "partitions" that are attached to the glide that can be dimensionally changed without removal, and in some embodiments, changed at a single-point location.

Various embodiments of a shelving glide according to the present disclosure may also include one or more of the following features. The shelving glide may provide the proper height to prevent container fall-over. Further, the shelving glide may provide for beverage container dividers that can be removed from and/or added into the glide without major assembly requirements. The shelving glide may also allow for a loading surface to support one or more consumer products prior to loading into the shelving glide. Further, the shelving glide may provide for proper glide operation independent or substantially independent of a shelf surface or shelving system. The shelving glide may also provide for assembly during installation. The shelving glide may also provide for cleaning and/or sterilization (e.g., liquid, air, or otherwise) without disassembly. The shelving glide may include a minimum friction glider deck that functions with less gravity pitch angle to reduce the total stack weight of multiple beverage containers. The shelving glide may aid in the removal of a single front product container by a customer. The shelving glide may also reduce the gravity impact of the stack weight against a front stop after the product container is removed. Additionally, the shelving glide may include a minimum glider deck pitch angle providing less clearance between shelving and resulting in more volume of displayed product containers in a given area of shelving.

These general and specific aspects may be implemented using a device, system or method, or any combinations of devices, systems, or methods. The details of one or more embodiments are set forth in the accompanying drawings and the description below. Other features, objects, and advantages will be apparent from the description and drawings, and from the claims.

DETAILED DESCRIPTION

In one embodiment, a shelving glide supports and displays one or more consumer product containers (e.g., food and/or beverage containers or other containers) on a shelving system, such as, for example, a cooler vault shelving system. The shelving glide includes a deck, or frame, and multiple partitions extending substantially vertically from the deck. The partitions define one or more product flow paths and are coupled to the deck via one or more clips. In some aspects, a partition is coupled to the deck or a component of or attached to the deck (such as an indexing trough) at a front and a back end of the partition. In some aspects, the back end clip may be detached from the deck and the partition may be rotated around a fulcrum to detach the front clip from the deck. The partition may be adjusted along a width of the deck by single-point contact to adjust the width of one or more flow paths. In some aspects, a user of the shelving glide in, for example, a cooler vault, may adjust the width of one or more flow paths from a single location at the rear of the shelving glide.

Figure 1:
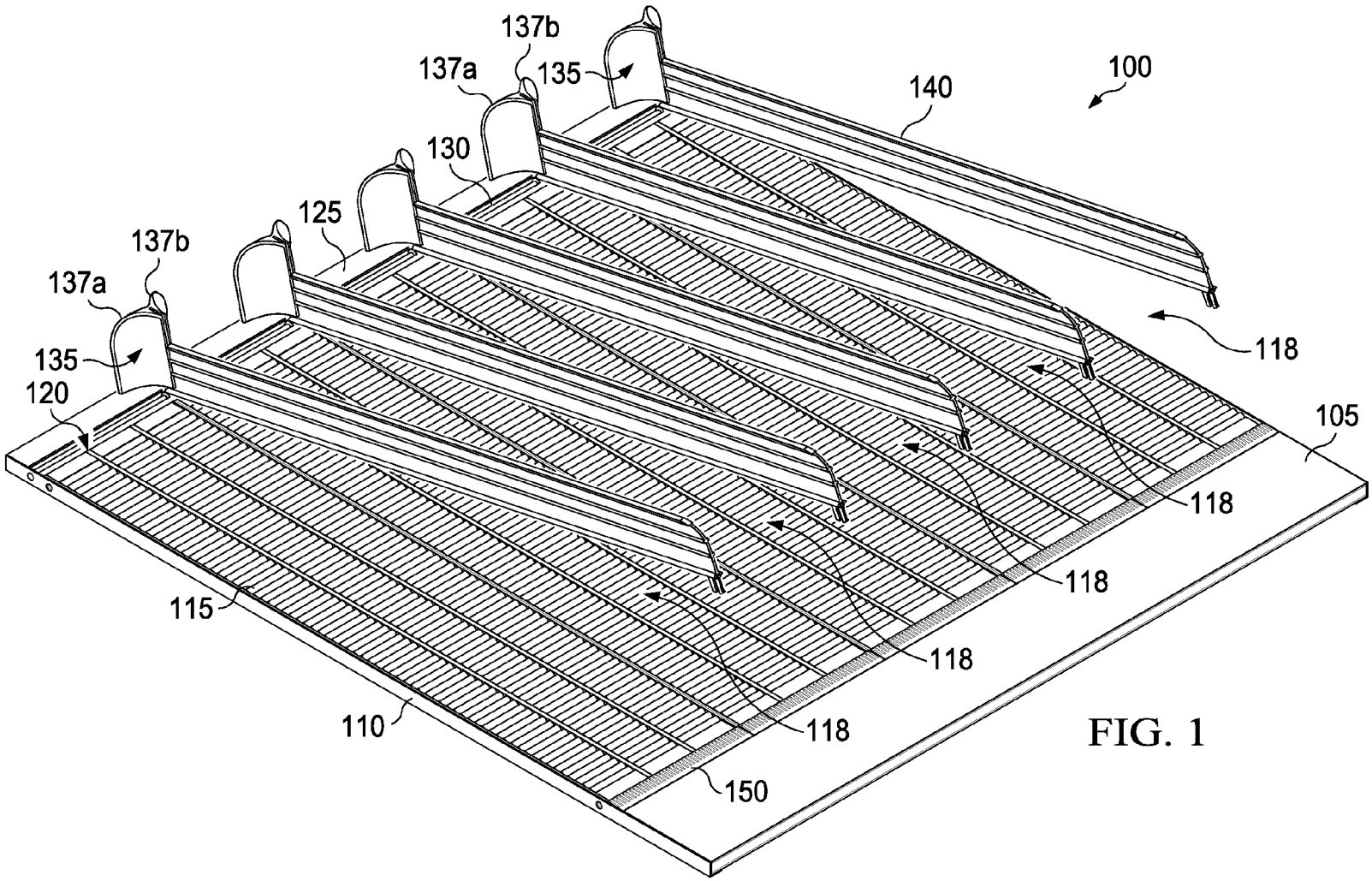
FIG. 1 illustrates one embodiment of a shelving glide in accordance with the present disclosure.

FIG. 1 illustrates one example embodiment of a shelving glide 100. The illustrated shelving glide 100 includes a stage 105, one or more side angles 110, a plurality of rollers 115, a deck 120, a bumper 125, a front trough 130, one or more product stops 135, one or more partitions 140, and a back trough 150. Typically, the shelving glide 100 supports multiple consumer products on a shelving system such as, for example, a shelving system located within a cooler vault. In some embodiments, the shelving glide 100 may be installed on a shelf positioned at a pitched angle. Thus, consumer product containers loaded on to the shelving glide 100 may be urged toward a front of the glide 100 (toward the product stops 135) by a gravity feed. Once a consumer product container is removed from the front of the shelving glide 100, additional consumer product containers located rearward of the removed container may be urged toward the product stops 135 by gravity.

As shown in FIG. 1, the stage 105 is coupled to the back trough 150 at the rear portion of the glide 100. The stage 105 may overhang the shelving system on which the glide 100 is placed, thereby providing a substantially planar surface on which to place consumer product containers prior to their loading onto the glide 100. Generally, the stage 105 is designed to support the weight of multiple consumer product containers. In some aspects of the glide 100, the stage 105 may be an extruded plastic component coupled to the back trough 150.

One or more side rails 110 may be connected to the deck 120 of the shelving glide 100. In some aspects, two side rails 110 may be connected to opposing sides of the shelving glide 100. As shown more fully in FIG. 2, the side rail 110 is an "L"-shaped structural member that may provide stability to the shelving glide 100 when loaded with consumer product containers. Alternatively, other stabilizing techniques may be utilized in addition to or in place of the side rails 110.

A plurality of rollers 115 may be installed within the shelving glide 100 transverse to a longitudinal dimension of the glide 100. The rollers 115, typically, provide a reduced friction surface on which consumer product containers may move toward the product stops 135 while influenced by the force of gravity. Generally, each roller 115 may be a cylindrical molding with a reduced axle pin on each end. The rollers 115 may spin freely or substantially freely within the shelving glide 100 and, more particularly, the deck 120, thereby creating a rotatable surface on which the consumer product containers may independently move forward (e.g., at a downward angle) as one or more containers within a line of containers are removed. In some aspects, the rollers 115 may be between 1 inch and 2 inches long and may be made of steel, aluminum, plastic, or other material.

The deck 120 of the shelving glide 100 is a substantially planar component in which various components of the shelving glide 100 may be installed. For example, the deck 120 may be an extruded component that establishes a segment of the glider 100 surface and a receptacle for one or more roller frames 155. Additionally, in some aspects, the deck 120 may be coupled to the front trough 130 and the back trough 150, thereby creating a substantially unified support structure for the shelving glide 100. In some embodiments, the deck 120 may include one or more substantially parallel dividers 117 extending between the rear end of the shelving glide 100 and the front end of the shelving glide 100, thereby creating one or more channels 122 into which the roller frames 155 may be installed. In some aspects, the parallel dividers 117 may provide additional structural stability for the deck 120 and the shelving glide 100.

The bumper 125 is located at the front end of the shelving glide 100 and, in some embodiments, may be coupled to the front trough 130. In the illustrated embodiment, the bumper 125 may provide additional structural stability to the shelving glide 100, as well as, for example, provide a location for product information (e.g., price, type, brand) to be displayed.

The front trough 130 is connected to the deck 120 and may provide multiple points of connection for the one or more partitions 140. For example, as shown in more detail in FIGS. 3 and 4, the front trough 130 may allow for incremental adjustment of the partitions 140 along a width of the front end of the shelving glide 100, thereby allowing for a width of any particular pathway 118 (i.e., container flow path) defined by two partitions 140 to be adjustable to substantially any size consumer product container.

One or more product stops 135 may be connected to corresponding partitions 140 at the front end of the shelving glide 100. Typically, the product stops 135 prevent (completely or substantially) consumer product containers from sliding or otherwise falling from the shelving glide 100 due to the force of gravity. The product stops 135 may be transparent moldings used to stop forward movement of containers and offer visual "see through" container identification. In some embodiments, as shown in FIG. 1, the product stops 135 may include opposing winged portions 137*a* and 137*b*, thereby allowing a single product stop 135 to impede the movement of consumer product containers in multiple lanes of the shelving glide 100. Alternatively, the product stops 135 may be connected to the bumper 125 or other portion of the shelving glide 100.

One or more partitions 140 may be connected to the front trough 130 and the back trough 150 of the shelving glide 100. The illustrated partitions 140 define one or more pathways 118 in which consumer product containers may be inserted. For example, the partitions 140 may be extruded dividers used to separate consumer product containers, establish movement pathways for such containers, and prevent container damage. Further, the partitions 140 may, in some embodiments, be individually removable and incrementally adjustable along the front end and the back end portions of the shelving glide 100, thereby allowing for the pathways 118 defined by the partitions 140 to be adjusted according to the one or more sizes of the consumer product containers to be loaded into the glide 100.

Figure 2:
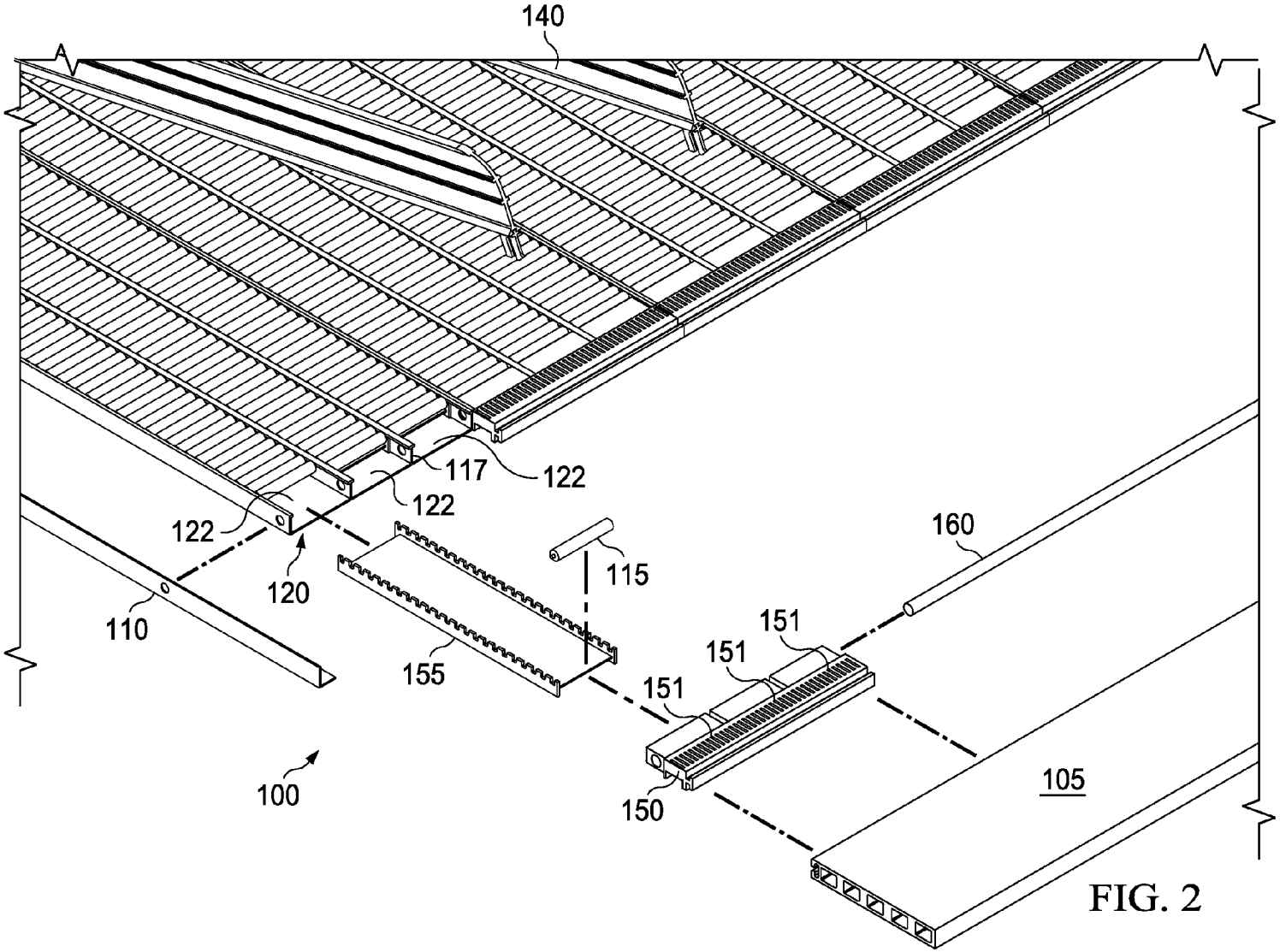
FIG. 2 illustrates an exploded view of one embodiment of a shelving glide in accordance with the present disclosure.

FIG. 2 illustrates an exploded view of a portion of one embodiment of the shelving glide 100. More specifically, FIG. 2 illustrates an exploded view of the back end of the shelving glide 100, including the stage 105, the side angle 110, rollers 115, the deck 120, partitions 140, the back trough 150, a roller frame 155, and an assembly rod 160.

As shown in FIG. 2, the stage 105 may include a latticed cross-sectional configuration for increased strength and decreased weight. In some aspects, the stage 105 may slideably connect to the back trough 150 via an extruded flanged or "T" portion of the trough 150.

The illustrated back trough 150 may be segmented such that multiple sections of the trough 150 extend across the back end of the shelving glide 100. Alternatively, the back trough 150 may be a single piece component extending across the back end of the glide 100. In some aspects, as illustrated in FIG. 2, the back trough 150 may include a plurality of substantially rectangular grooves 151 (e.g., apertures) formed into a top surface of the trough 150 (e.g., an indexing trough). As explained more fully with reference to FIG. 5, such grooves 151 may allow for the partitions 140 to be connected to the back trough 150 at incremental locations across the back end of the shelving glide 100.

The back trough 150 may further be coupled to the deck 120 through the assembly rod 160. For example, the back trough 150 and the deck 120 may include substantially circular apertures that may be aligned as the back trough 150 (or back troughs 150) is inserted into the deck 120. The assembly rod 160 may thus be inserted through both the back trough 150 and the deck 120 via the substantially circular apertures located in each. In some aspects, the assembly rod 160 may be fastened or otherwise secured to the side angle 110 by screws, bolts, snaps, or other fastener.

Multiple roller frames 155 may be inserted into the channels 122 within the deck 120 defined by the dividers 117 of the deck 120. In some embodiments, the roller frames 155 may include multiple slots on which the rollers 115 may be seated and rotate. As shown in FIG. 2, the roller frames 155 may be segmented into multiple roller frames that may be inserted into the channels 122 of the deck 120. Alternatively, a single roller frame 155 (e.g., a roller frame extending a length of a channel 122) may be inserted into each channel 122 of the deck 120.

The roller frames 155 may also, in some aspects, separate the channels 122 of the deck 120 into lower and upper portions. For example, the separated channels may allow for easier cleaning of the deck 120 by creating paths by which cleaning fluid may be introduced into the deck 120. Alternatively, cleaning fluid may be introduced into the channels of the deck 120 after removal of the roller frames 155 and rollers 115. In some embodiments, the roller frame 155 may include one or more drain holes to allow unwanted fluids to drain to the deck 120 for removal (e.g., immediately and/or future removal) from the shelving glide 100.

Figure 3:
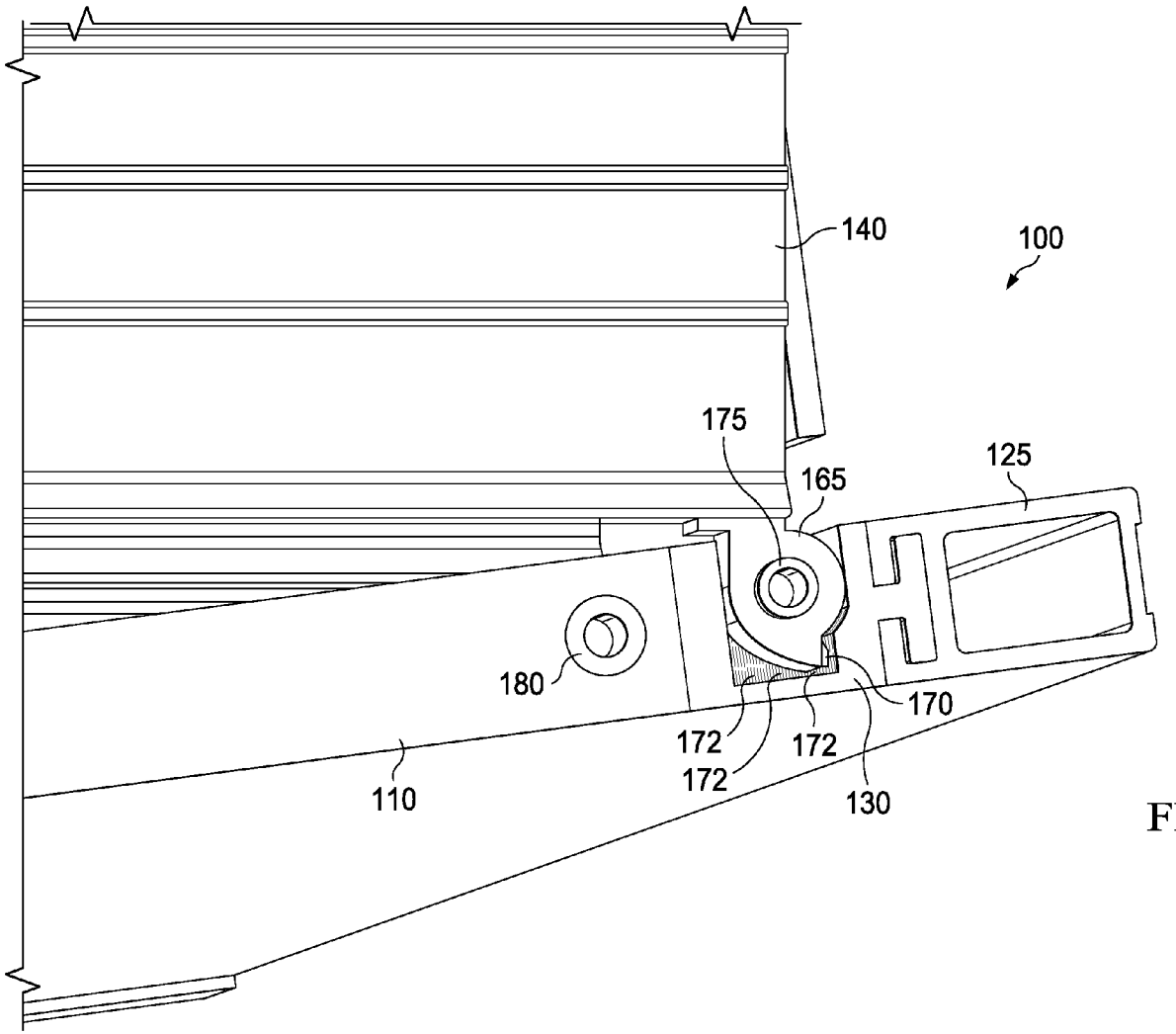
FIG. 3 illustrates a more detailed perspective of one embodiment of a shelving glide in accordance with the present disclosure.

FIG. 3 illustrates a more detailed perspective of a portion of one embodiment of the shelving glide 100. More specifically, FIG. 3 illustrates one embodiment of the front end of the shelving glide 100. Certain embodiments of the shelving glide 100 may include a front clip 165, a clip rod 175, and an assembly rod 180. Further, in some embodiments, the front trough 130 of the shelving glide 100 may include an index 170. The illustrated front trough 130 and index 170 may allow a partition 140 to be positioned at multiple locations along the front end of the shelving glide 100.

As shown in FIG. 3, the bumper 125 may be coupled to the front trough 130 via an extruded or "T" flange of the front trough 130. The front trough 130 (as shown more fully in FIG. 4) may also be coupled to the deck 120 via the assembly rod 180. The front trough 130 may further include a slot running the length of the front trough 130 whereby the front clip 165 may be inserted. The clip rod 175 may be inserted through one or more front clips 165, thereby allowing the front clips 165 to rotate about the clip rod 175.

The front trough 130 may include the index 170 along a front wall of the front trough 130. The illustrated index 170 may consist of multiple notches 172 (e.g., apertures or ribs) formed in the front wall of the front trough 130 into which a pin of the front clip 165 may be inserted.

In some embodiments, the front clip 165 may be connected to the partition 140 such that lateral movement of the front clip 165 on the clip rod 175 may also move the partition 140 along the front end of the shelving glide 100. For example, a user may rotate the front clip 165 clockwise (as viewed in FIG. 3) by lifting the partition 140 at the back end of the shelving glide 100. Upon rotation of the front clip 165, the clip 165 may be disengaged from a notch 172 of the index 170, thereby allowing lateral movement of the front clip 165 along the clip rod 175. The front clip 165 may then be reengaged with the index 170 by, for example, rotating the partition 140 counterclockwise.

Figure 4:
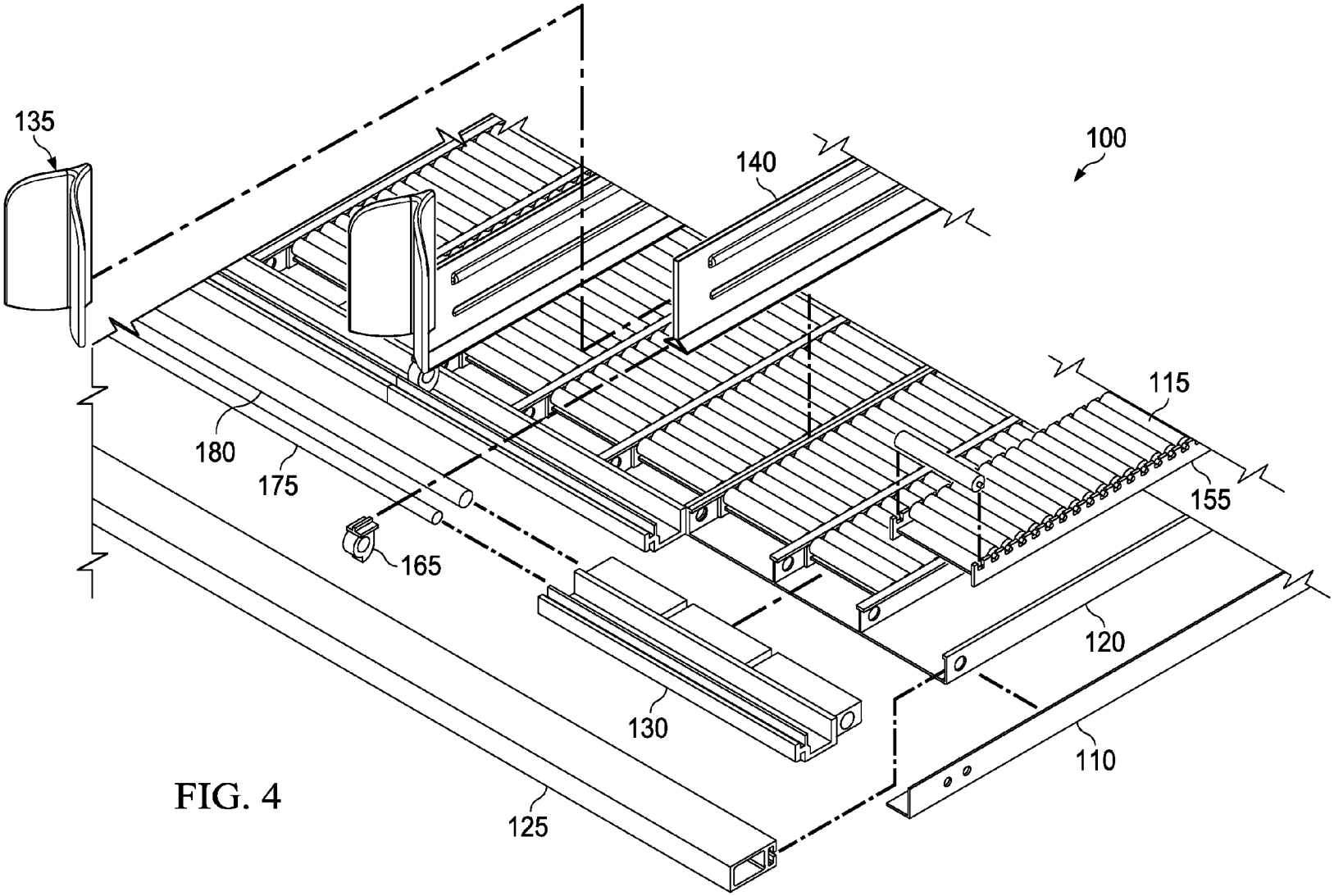
FIG. 4 illustrates another exploded view of one embodiment of a shelving glide in accordance with the present disclosure.

FIG. 4 illustrates another exploded view of one embodiment of the shelving glide 100. More particularly, FIG. 4 illustrates an exploded view of the front end of the shelving glide 100, including the side angle 110, rollers 115, the deck 120, the bumper 125, the front trough 130, product stops 135, partitions 140, the roller frame 155, the clip rod 175, and the assembly rod 180.

As shown in FIG. 4, the front trough 130 (or front troughs 130) may be connected to the front end of the deck 120 via the assembly rod 180. The assembly rod 180 may, for instance, be inserted through circular or substantially circular apertures formed in the front trough 130 and the deck 120. The assembly rod 180 may also be fastened to or otherwise secured to the side angle 110 by, for example, a screw, rivet, snap, bolt, or other fastener. Further, in some embodiments, the clip rod 175 may be attached to or otherwise secured to the side angle 110.

As described above with reference to FIG. 2, multiple roller frames 155 may be inserted into channels within the deck 120 defined by the deck dividers 117. Multiple rollers 115 may be seated into slots formed in the top of the roller frame 155, thereby allowing the rollers 115 to rotate substantially freely within the slots as consumer product containers move over the rollers 115.

Figure 5:
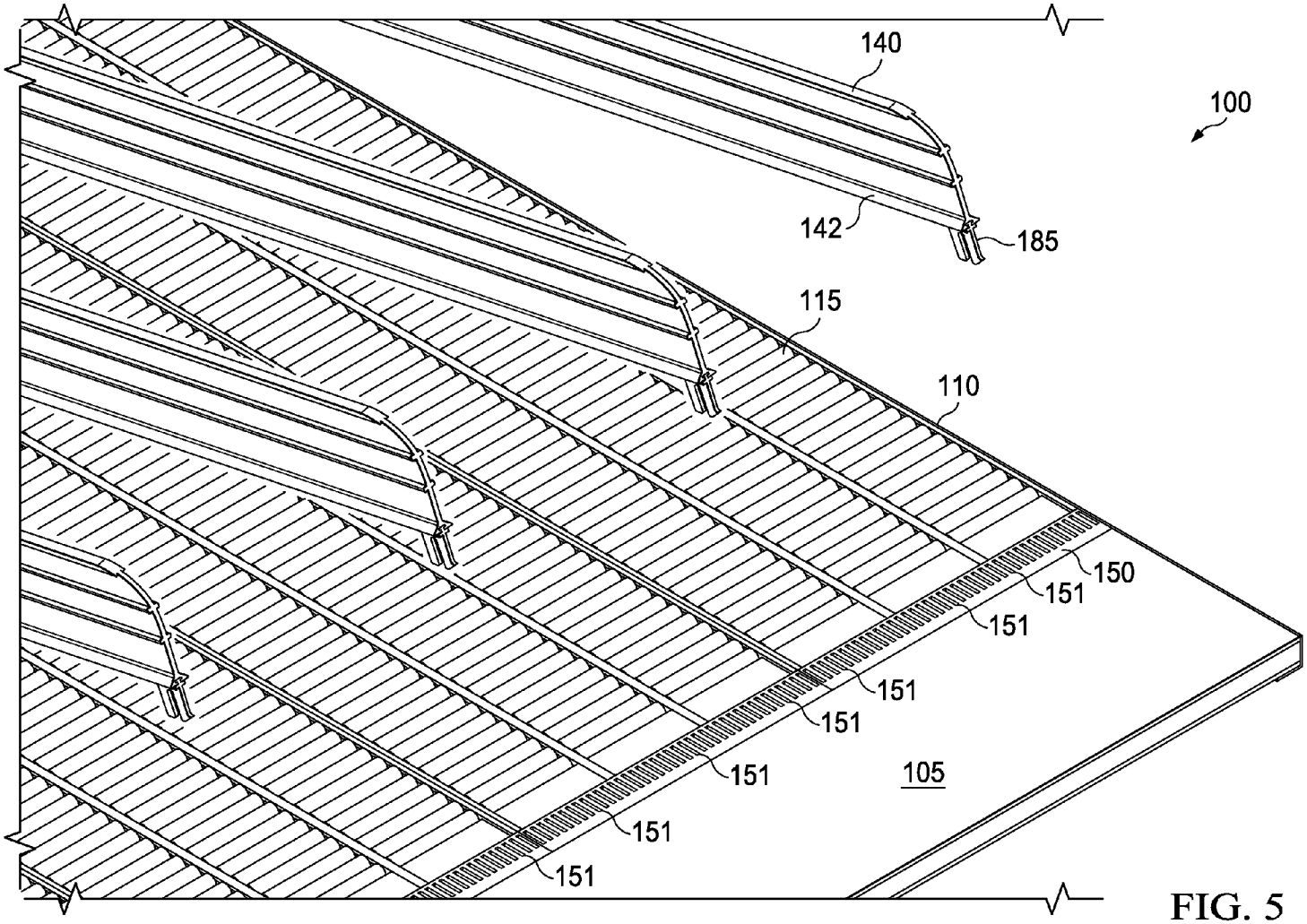
FIG. 5 illustrates a more detailed perspective of a rear portion of one embodiment of a shelving glide in accordance with the present disclosure.

FIG. 5 illustrates a more detailed perspective of a rear portion of one embodiment of the shelving glide 100. In some embodiments, the shelving glide 100 may include a back clip 185 connected to some or all of the partitions 140. Thus, the partitions 140 may be connected to the back trough 150 through the back clips 185. For example, as noted above, the back trough 150 may include multiple substantially rectangular grooves 151 formed in the top of the trough 150. Each back clip 185 may be inserted into a particular groove 151 of the back trough 150 in order to secure the partition 140 to the deck 120 at a particular position.

In some embodiments, as shown in FIG. 5, the partition 140 may include a ribbed cross-section, thereby providing additional structural support and stability to the partition 140. Additionally, in some embodiments, the partition 140 may include a flared base 142, further increasing structural stability. The flared base of the partition 140 may, in some aspects, be overhung by at least a portion of a consumer product container placed upon the rollers 115.

Further, in some embodiments of the shelving glide 100, the partition 140 may be connected to the deck 120 at a point between the front end of the shelving glide 100 and the back end of the shelving glide 100. For instance, one or more additional clips (not shown) may be inserted into the flared base 142 of the partition 140 and coupled to the deck 120 at, for example, a divider 117 of the deck 120.

In some aspects of operation of the shelving glide 100, a user may load one or more, or preferably many, product containers on the stage 105 in order to expedite loading of the containers into the one or more pathways 118. For example, the user may load all or a part of a case (or other unit) of containers on the stage 105 first and then load the containers into the pathways 118, thereby decreasing loading time and/or effort. In certain instances, the user may determine that one or more pathways 118 may need to be wider or narrower. The user may then detach a particular partition 140 from the deck 120 by, for example, lifting up on a rear end of the partition 140 proximate to the stage 105 to disengage the back clip 185 from a particular groove 151 in the back trough 150. Once disengaged, the partition 140 may be rotated (e.g., counter-clockwise) in order to rotate the corresponding front clip 165 around the clip rod 175. Upon rotation, the front clip 165 disengages from a corresponding notch 172 of the index 170. The user may then slidingly adjust the partition 140 along a width of the deck 120 to adjust the widths of one or more pathways 118. The user may then rotate the partition (e.g., clockwise) to reengage the front clip 165 to another notch 172 in the index 170. Once reengaged, the partition 140 may be secured again to the deck 120 by reengaging the back clip 185 to another groove 151.

In some aspects, the shelving glide 100 may be self-indexing. For example, there may be a one-to-one correspondence between grooves 151 and notches 172 such that when the user engages the back clip 185 to a particular groove 151, the front clip 165 is automatically engaged with the corresponding notch 172. In such fashion, each pathway 118 may have a uniform or substantially uniform width throughout an entire length of the pathway 118. Further, each partition 140 may be substantially parallel to other partitions 140.

Figure 6:
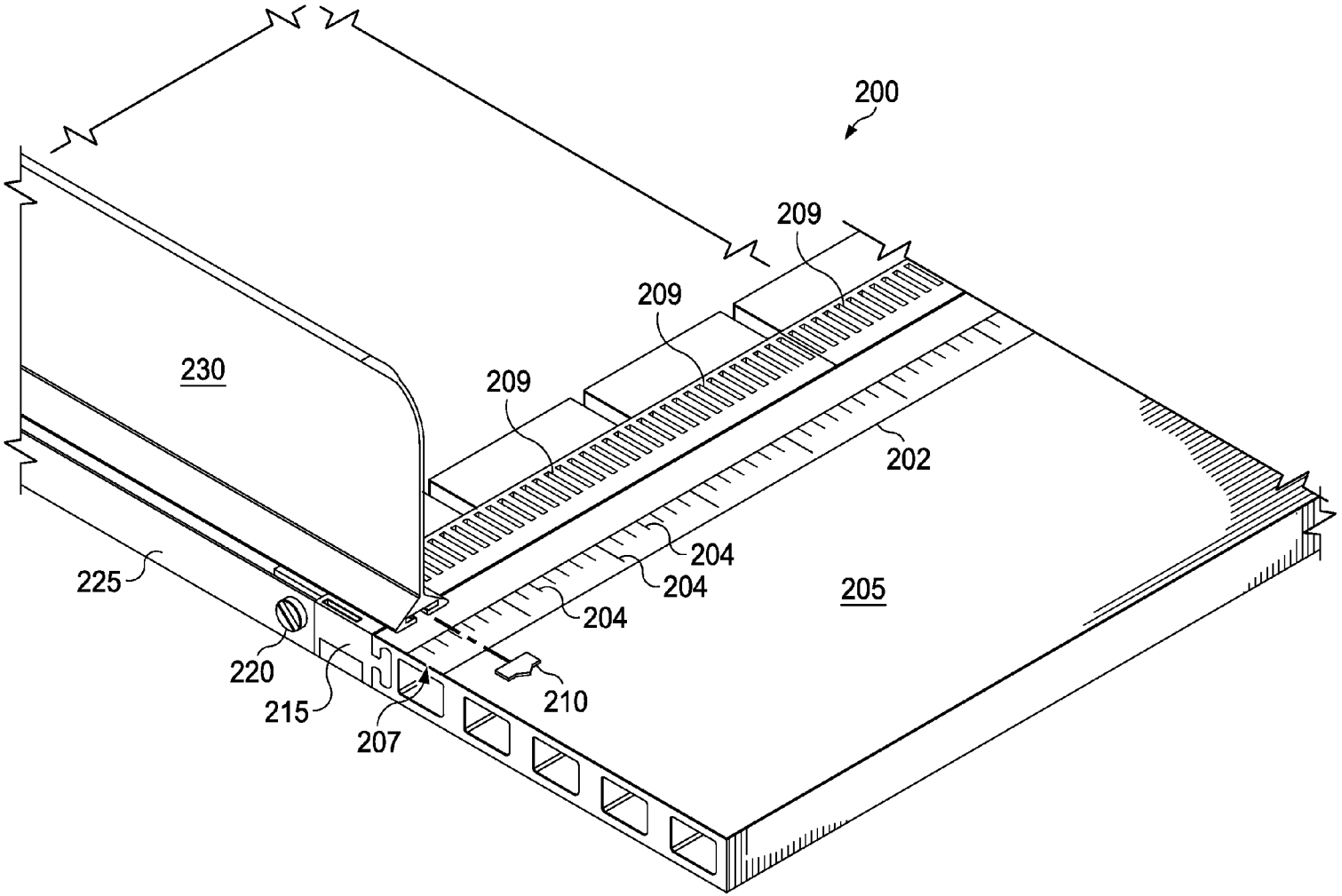
FIG. 6 illustrates a detailed view of a rear portion of another embodiment of a shelving glide in accordance with the present disclosure.

FIG. 6 illustrates a detailed view of a rear portion of another embodiment of a shelving glide. More specifically, FIG. 6 illustrates a shelving glide 200, including a stage 205, a back trough 215, a side angle 225, and a partition 230. Shelving glide 200 may also include a cap screw 220 that secures an assembly rod (not shown) to the side angle 225. In some aspects of shelving glide 200, the partition 230 may overhang the back trough 215 by, for example, approximately 16 millimeters.

Shelving glide 200 may also include a label recess 207 and a back pointer 210. The back pointer 210 may be inserted into a flanged base portion of the partition 230 and include a tip extending from the partition 230. The tip of the back pointer 210 may, in some embodiments, indicate a specific location of the partition 230 according to a ruler 202 located on the label recess 207. The ruler, for instance, may include one or more tick marks 204 aligned with and corresponding to each groove 209 located on a top surface of the back trough 215. Thus, a user of the shelving glide 200 may align the partition 230 at a specific location along a width of the shelving glide 200 according to the ruler 202 located on the label recess 207. Alternatively, the label recess 207 may include one or more marks at various intervals corresponding to particular apertures on the back trough 215.

Figure 7:
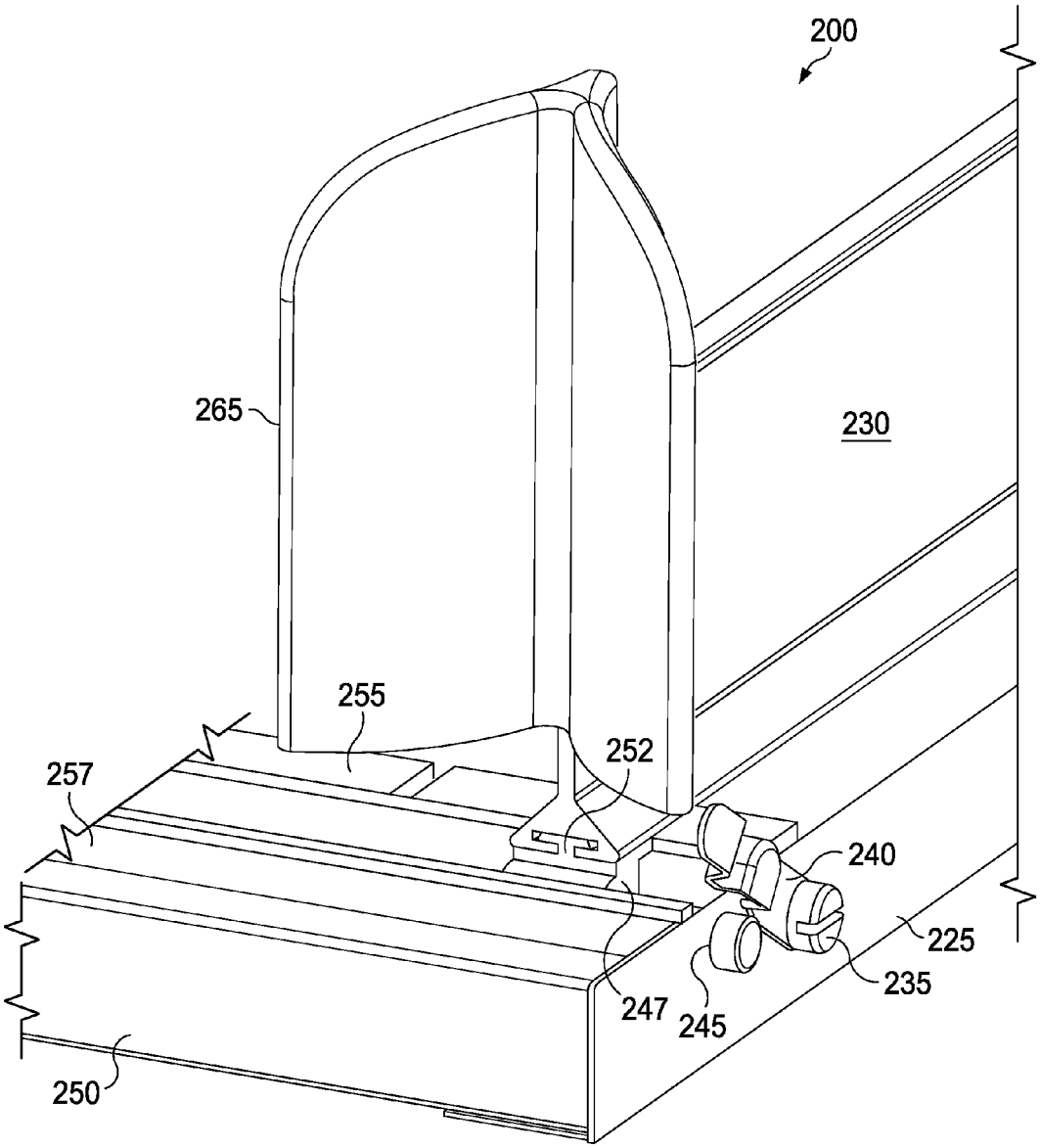
FIG. 7 illustrates a detailed view of a front portion of another embodiment of a shelving glide in accordance with the present disclosure.

FIG. 7 illustrates a detailed view of a front portion of one embodiment of the shelving glide 200. As illustrated, the shelving glide 200 may include a rod fastener 235 that secures an assembly rod (not shown) through a front trough 255 and the side angle 225. The shelving glide 200 also includes a deck (not shown), which, in some aspects, may be substantially similar to the deck 120 of the shelving glide 100. The deck of shelving glide 200 may, alternatively, also include one or more drain holes located in a bottom surface of the deck to facilitate the removal of unwanted fluids and cleaning of the shelving glide 200. The holes, in some aspects, may be located along the front end of the shelving glide 200 to allow for draining fluids out of the shelving glide 200. The deck may also include apertures through which a center assembly rod may be inserted to, for example, increase stability of the shelving glide 200.

As shown in FIG. 7, a clip rod cap 240 may also be rotatably secured to the side angle 225 via the rod fastener 235 without, in some aspects, any tool requirement. The clip rod cap 240 may thus be rotated to cover a portion of a clip rod 245 extending from an aperture of the side angle 225. The clip rod 245 may be inserted through the front trough 255 and through one or more front clips 247. Once covered, the clip rod 245 may be less likely to be accidentally or impermissibly removed from the shelving glide 200.

In some embodiments, a clip rod cap 240 may be utilized on both sides of the shelving glide 200. Further, in some aspects, the clip rod 245 may be sized such that one or more front clips 247 may be removed from the clip rod 245 without complete removal of the clip rod 245 from the shelving glide 200.

Shelving glide 200 may also include a front pointer 252 and a label recess 257. In some aspects, the front pointer 252 and the label recess 257 may be substantially similar to the back pointer 210 and the label recess 207. For example, the front pointer 252 may be inserted into a flared base portion of the partition 230. In some aspects, the front pointer 252 may be secured into place by, for example, an adhesive. Further, the front pointer 252 may include a tip extending from the partition 230. The tip of the front pointer 252 may, in some embodiments, indicate a specific location of the partition 230 according to a ruler located on the label recess 257. The ruler may include tick marks aligned with and corresponding to each notch of an index of the front trough 255 (such as the clip index 170 of the front trough 130 shown in FIG. 3). Thus, a user of the shelving glide 200 may align the partition 230 at a specific location along a width of the shelving glide 200 according to the ruler located on the label recess 257. The label recess 257 may alternatively include one or more marks at various intervals corresponding to particular apertures of the index of the front trough 255.

Figure 8:
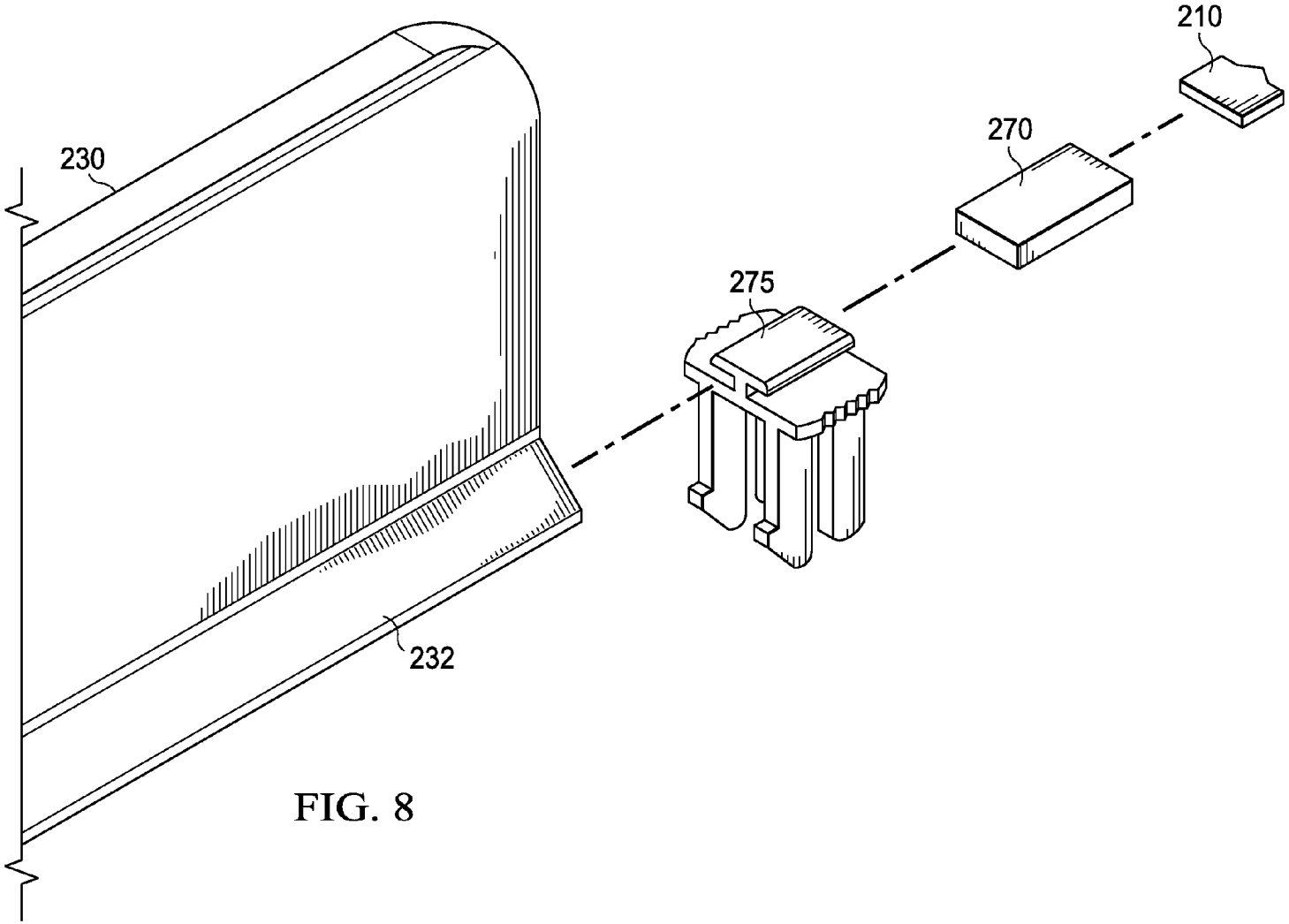
FIG. 8 illustrates an exploded view of various components of another embodiment of a shelving glide in accordance with the present disclosure.

FIG. 8 illustrates an exploded view of various components of one embodiment of the shelving glide 200. More specifically, FIG. 8 illustrates one embodiment of a back end of the partition 230 of the shelving glide 200. For example, the partition 230 may include a flared bottom portion 232 containing a t-shape recess through (entirely or partially) a length of the partition 230. Into this recess, a back clip 275, which may include a t-shape flange along a top portion may be inserted. An insert 270, such as a rubber insert, may also be inserted into the recess subsequent to the back clip 275. Further, the back pointer 210 may be inserted and secured within the recess subsequent to the insert 270. The insert 270 may, in some aspects, apply a forward force (e.g., away from the partition 230) against the back pointer 210. Additionally, in some embodiments, a partition strap (not shown) may be inserted into the recess prior to the back clip 275 and through substantially the entire length of the partition 230. The partition strap, in some aspects, may be a metal member, and may provide a stop for the back clip 275. Further, the partition strap may increase structural stability of the partition 230.

Figure 9:
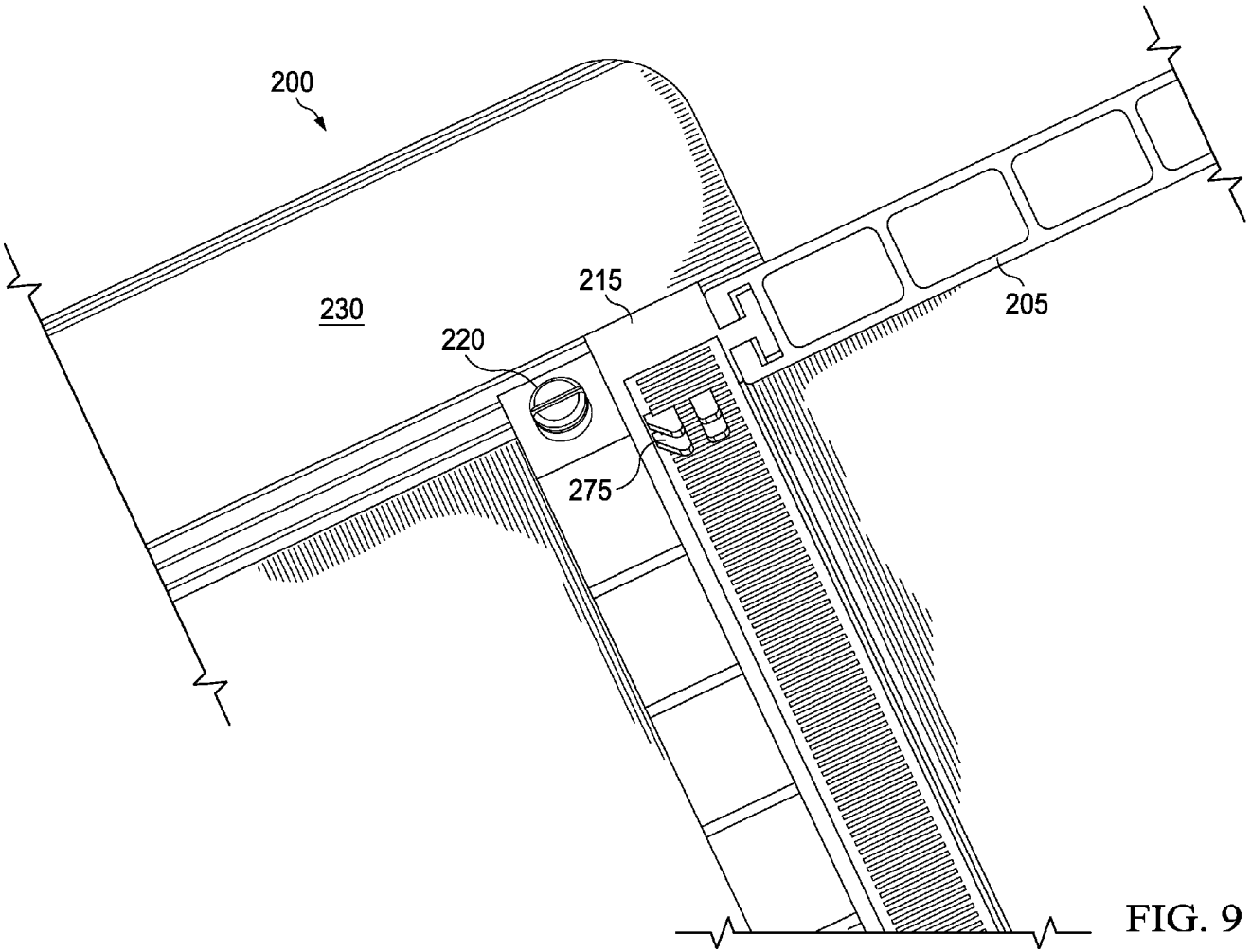
FIG. 9 illustrates a detailed view of a rear portion of another embodiment of a shelving glide in accordance with the present disclosure.

The back clip 275 may, in some aspects, be wider than the flared base 232 of the partition 230 and include textured sides to allow, for example, a user to more easily grasp and/or insert the back clip 275 into the partition 230, move the partition 230 secured to the back clip 275, or to generally handle the back clip 275. The back clip 275 may also include up to four legs, which secure the back clip 275 to the back trough 215 (as shown in FIG. 9). In some aspects, one or more of the legs of the back clip 275 may include hooked ends to more securely fasten the back clip 275 to the back trough 215.

FIG. 9 illustrates a detailed view of a rear portion of one embodiment of the shelving glide 200. More specifically, FIG. 9 shows the back clip 275 inserted through apertures of the back trough 215. In such fashion, the partition 230 may be detachably secured to the back trough 215. In some embodiments, the partition 230 may be detached from the back trough 215 by lifting the partition 230 away from the back trough 215 and toward the stage 205, thereby removing the back clip 275 from the apertures. Subsequently, the partition 230 may be adjusted in either direction along the width of the back trough 215.

Figure 10:
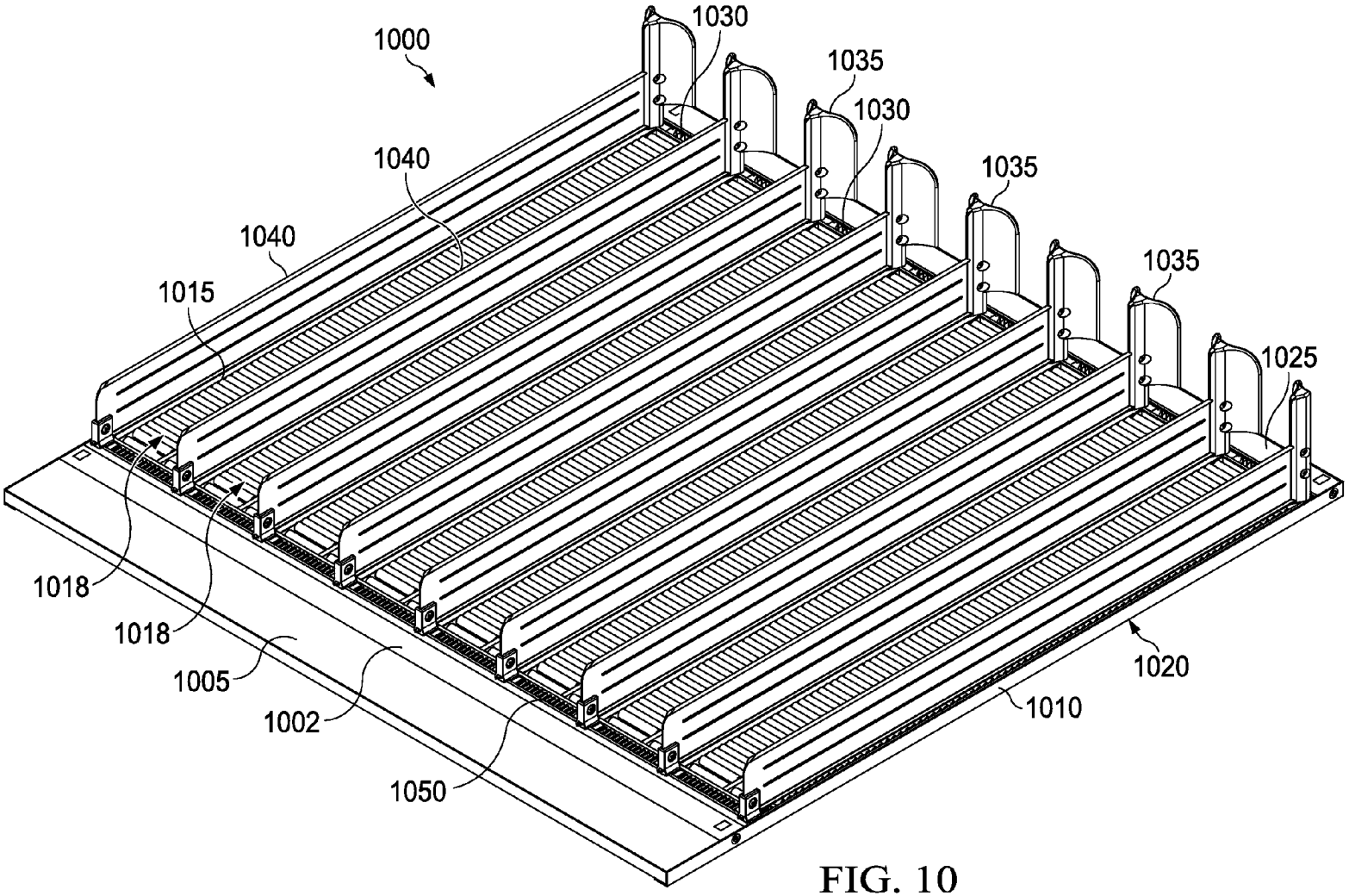
FIG. 10 illustrates another embodiment of a shelving glide in accordance with the present disclosure.

FIG. 10 illustrates another embodiment of a shelving glide 1000. As illustrated, shelving glide 1000 includes a stage 1005, one or more side angles 1010, a plurality of rollers 1015, a deck 1020, a bumper 1025, a front trough 1030, one or more product stops 1035, one or more partitions 1040, and a back trough 1050. In some implementations, the shelving glide 1000 may include a ruler 1202 proximate to the back trough 1050. As illustrated, the shelving glide 1000 supports multiple consumer products on a shelving system such as, for example, a shelving system located within a cooler vault. In some embodiments, the shelving glide 1000 may be installed on a shelf positioned at a pitched angle. Consumer product containers loaded on to the shelving glide 1000 may be urged toward a front of the glide 1000 (toward the product stops 1035) by a gravity feed. Once a consumer product container is removed from the front of the shelving glide 1000, additional consumer product containers located rearward of the removed container may be urged toward the product stops 1035 by gravity. All or some of the components of the shelving glide 1000 may be a rigid material, such as, for example, plastic, aluminum, stainless steel, or other rigid material.

As shown in FIG. 10, the stage 1005 is coupled to the back trough 1050 at the rear portion of the glide 1000. The stage 1005 may overhang the shelving system on which the glide 1000 is placed, thereby providing a substantially planar surface on which to place consumer product containers prior to their loading onto the glide 1000. Generally, the stage 1005 is designed to support the weight of multiple consumer product containers. In some aspects of the glide 1000, the stage 1005 may be an extruded plastic component coupled to the back trough 1050, such as, for example, via a t-flange connection. In alternative aspects, the stage 1005, the back trough 1050, and/or the deck 1020 may be a single piece structure, which may provide better structural stability and strength.

One or more side rails 1010 may be connected to the deck 1020 of the shelving glide 1000. In some aspects, two side rails 1010 may be connected to opposing sides of the shelving glide 1000. In some implementations of the shelving glide 1000, the side rails 1010 may be attached (e.g., mechanical secured by rivets, screws, or other mechanical technique) to the deck 1020 at four locations corresponding to or proximate to four corners of the shelving glide 1000.

A plurality of rollers 1015 may be installed within the shelving glide 1000 transverse to a longitudinal dimension of the glide 1000. The rollers 1015, typically, provide a reduced friction surface on which consumer product containers may move toward the product stops 1035 while influenced by the force of gravity. Generally, each roller 1015 may be a cylindrical molding with a reduced axle pin on each end. The rollers 1015 may spin freely or substantially freely within the shelving glide 1000 and, more particularly, the deck 1020, thereby creating a rotatable surface on which the consumer product containers may independently move forward (e.g., at a downward angle) as one or more containers within a line of containers are removed. In some aspects, the rollers 1015 may be between 1 inch and 2 inches long and may be made of steel, aluminum, plastic, or other material.

Figure 11:
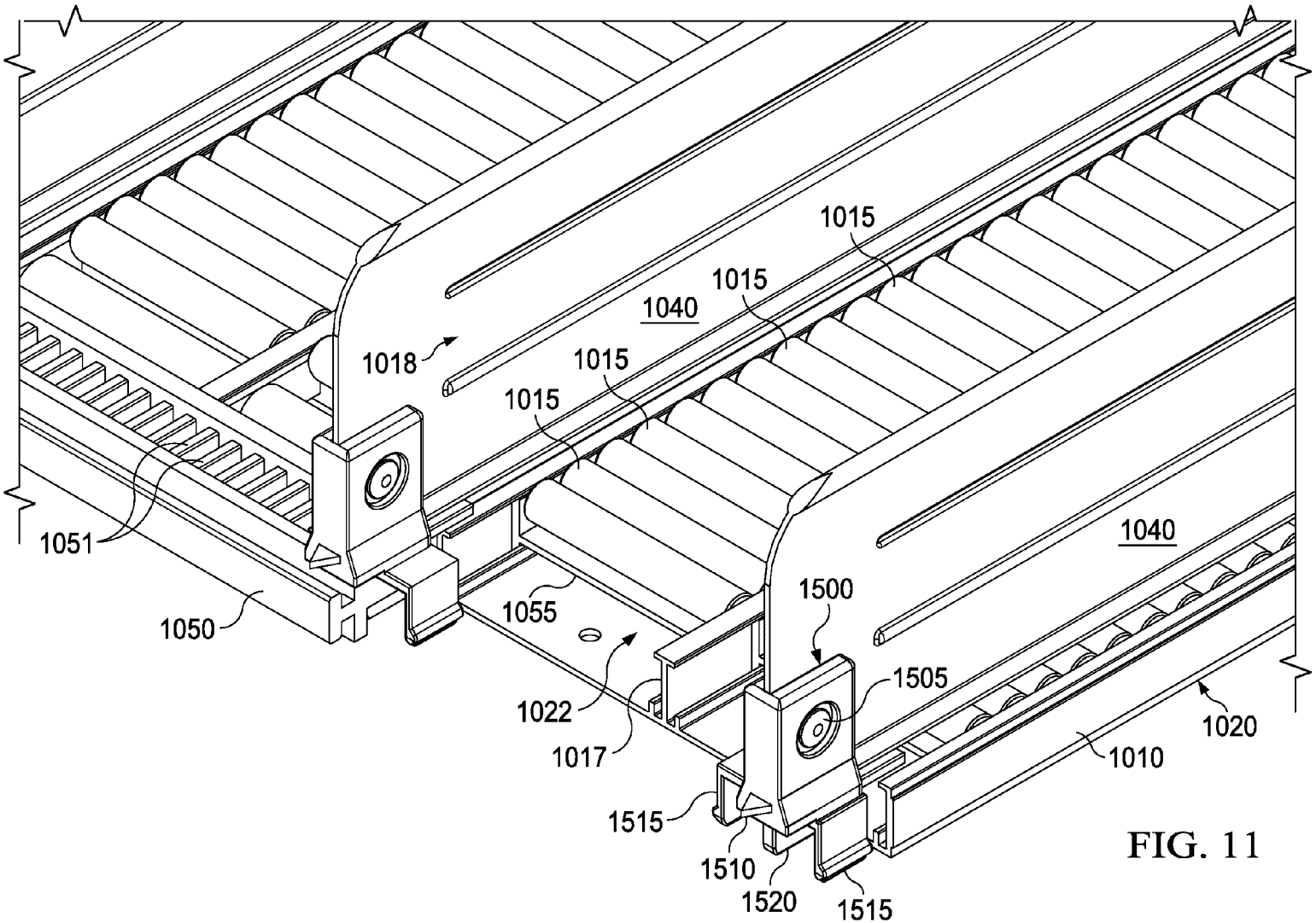
FIG. 11 illustrates a more detailed view of one portion of another embodiment of the shelving glide in accordance with the present disclosure.

The deck 1020 of the shelving glide 1000 is a substantially planar component in which various components of the shelving glide 1000 may be installed. For example, the deck 1020 may be an extruded component that establishes a segment of the glider 1000 surface and a receptacle for one or more roller frames 1055 (shown in FIG. 11). Additionally, in some aspects, the deck 1020 may be coupled to the front trough 1030 and the back trough 1050, thereby creating a substantially unified support structure for the shelving glide 1000. In some embodiments (as illustrated in FIG. 11), the deck 1020 may include one or more substantially parallel dividers 1017 extending between the rear end of the shelving glide 1000 and the front end of the shelving glide 100, thereby creating one or more channels 1022 into which the roller frames 1055 may be installed. In some aspects, the parallel dividers 1017 may provide additional structural stability for the deck 1020 and the shelving glide 1000.

In some aspects of shelving glide 1000, the deck 1020, the front trough 1030, and the back trough 1050 may be a single piece structure. For example, these components may be integrally formed as an extruded, single piece structure to, for example, increase strength and stability of the deck 1020. Alternatively, in some aspects, the front trough 1030 and the back trough 1050 may be compressed and secured against the deck 1020 by the bumper 1025 and the stage 1005, respectively, when the bumper 1025 and the stage 1005 are coupled to the deck 1020 by the side rails 1010. Further, in some aspects, at least one of the front trough 1030 and the back trough 1050 may be fit into slots disposed in the deck 1020 in order to detachably secure the corresponding trough 1030 and/or 1050 to the deck 1020.

The bumper 1025 is located at the front end of the shelving glide 1000 and, in some embodiments, may be coupled to the front trough 1030. In the illustrated embodiment, the bumper 1025 may provide additional structural stability to the shelving glide 1000, as well as, for example, provide a location for product information (e.g., price, type, brand) to be displayed.

The front trough 1030 is connected to or integral with the deck 1020 and may provide multiple points of connection for the partitions 1040. For example, as shown in more detail in FIG. 12, the front trough 1030 may allow for incremental adjustment of the partitions 1040 along a width of the front end of the shelving glide 1000, thereby allowing for a width of any particular pathway 1018 (i.e., container flow path)

defined by two partitions 1040 to be adjustable to substantially any size consumer product container, without, for example, removing adjacent or other partitions 1040 or consumer product containers from the shelving glide 1000.

One or more product stops 1035 may be connected to corresponding partitions 1040 at the front end of the shelving glide 100. Typically, the product stops 1035 prevent (completely or substantially) consumer product containers from sliding or otherwise falling from the shelving glide 1000 due to the force of gravity. The product stops 1035 may be transparent moldings used to stop forward movement of containers and offer visual "see through" container identification. In some embodiments, as shown in FIG. 10, the product stops 1035 may include opposing winged portions, thereby allowing a single product stop 1035 to impede the movement of consumer product containers in multiple lanes of the shelving glide 1000. Alternatively, the product stops 1035 may include a single winged portion, such as, product stops 1035 located at a corner of the deck 1020.

One or more partitions 1040 may be connected to the front trough 1030 and the back trough 1050 of the shelving glide 1000. The illustrated partitions 1040 define one or more pathways 1018 in which consumer product containers may be inserted. For example, the partitions 1040 may be extruded dividers used to separate consumer product containers, establish movement pathways for such containers, and prevent container damage. Further, the partitions 1040 may be individually removable and incrementally adjustable along the front end and the back end portions of the shelving glide 1000, thereby allowing for the pathways 1018 defined by the partitions 1040 to be adjusted according to the one or more sizes of the consumer product containers to be loaded into the glide 1000.

FIG. 11 illustrates a more detailed view of one portion of the shelving glide 1000. In particular, FIG. 11 illustrates another embodiments of a back clip 1500 that may be utilized to secure the partition 1040 to the deck 1020 generally, and one or more grooves 1051 of the back trough 1050. The illustrated back clip 1500 may be attached to the partition 1040 at or near a back edge of the partition 1040 by a fastener 1505 (e.g., a screw, rivet, pin, or other fastener). In some aspects, as illustrated, the back clip 1500 may include a lower flared portion connected to an upper portion. Coupled or attached to the flared portion may be one or more prongs, such as the illustrated center prong 1520 and the outer prongs 1515. Although three prongs are illustrated in FIG. 11, more or fewer prongs may be utilized in back clip 1500.

The illustrated prongs (i.e., center prong 1520 and outer prongs 1515) may be detachably secured to grooves 1051. In some aspects, the prongs 1515 and 1520 may be secured to three adjacent grooves 1051. Alternatively, the prongs 1515 and 1520 may be secured to particular grooves 1051 with other grooves 1051 in between.

As illustrated, outer prongs 1515 may include a lower detent portion that hooks, or grabs, an underside of a groove 1051 in order to secure the partition 1040 to the back trough 1050. In particular, in some aspects, the prongs 1515 may be secured into grooves 1051 and released from said grooves 1051 by forcibly inserting and removing, respectively, the prongs 1515 from the grooves 1051.

The back clip 1500 may also include a pointer 1510 extending from a back side of the clip 1500. In some aspects, the pointer 1510 may be aligned with one or more tick marks on the ruler 1202 in order to align or help align the partition 1040 at a particular position along a width of the shelving glide 1000. For example, the pointer 1510 may be aligned at a particular position along the rule 1202 in order for the pathway 1018 to accommodate a product container of a particular width or size.

Figure 12:
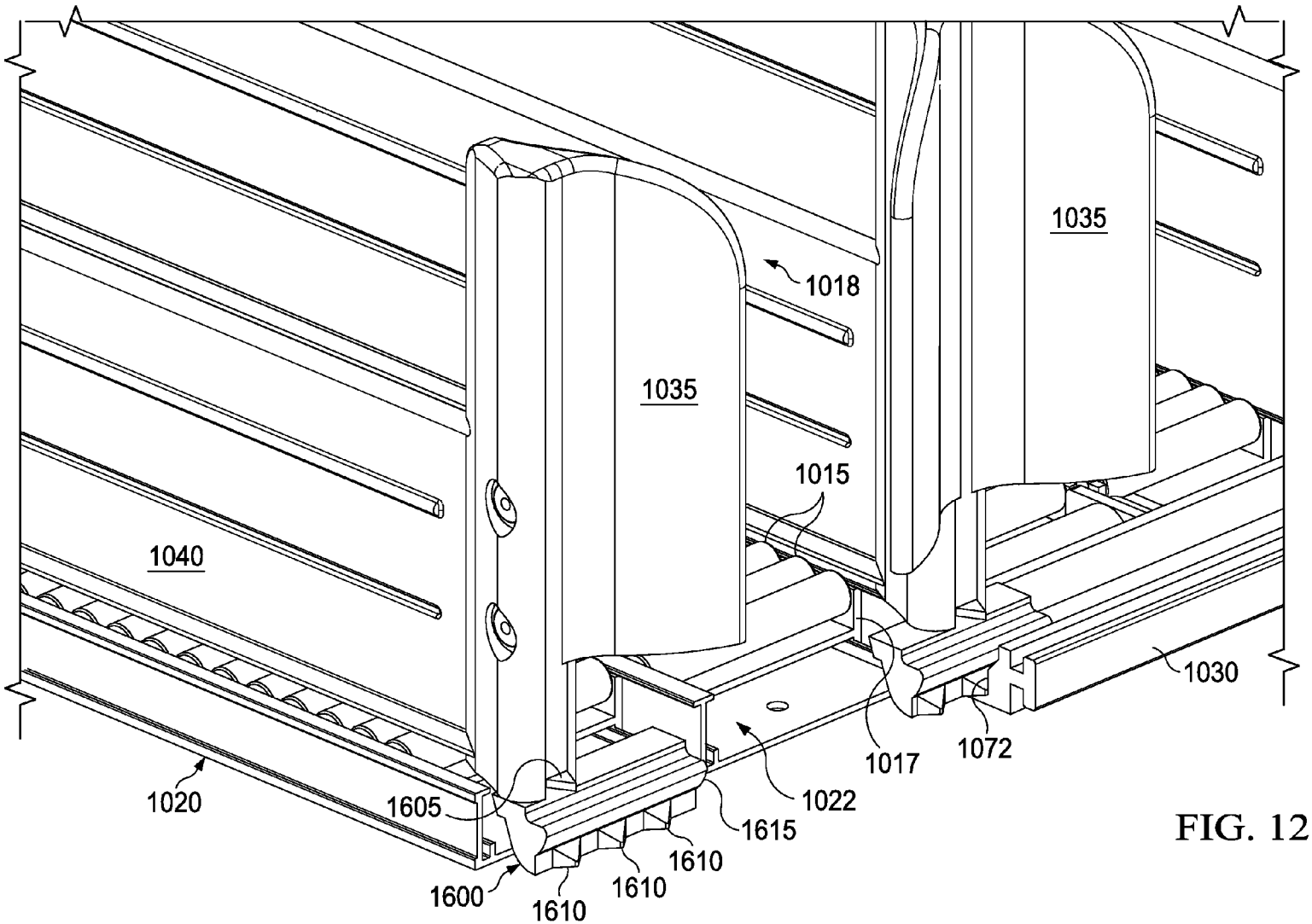
FIG. 12 illustrates a more detailed view of another portion of another embodiment of the shelving glide in accordance with the present disclosure.

FIG. 12 illustrates a more detailed view of another portion of the shelving glide 1000. In particular, FIG. 12 illustrates another embodiments of a front clip 1600 that may be utilized to secure the partition 1040 to the deck 1020 generally, and one or more notches 1072 of the front trough 1030. The illustrated front clip 1600 may be attached to the partition 1040 at or near a front edge of the partition 1040. In some aspects, as illustrated, the front clip 1600 may include a shoulder 1615 and one or more cleats 1610. Although three cleats 1610 are illustrated in FIG. 12, more or fewer cleats 1610 may be utilized in front clip 1600. For instance, additional cleats (e.g., more than one) may more securely connect the partition 1040 to the front trough 1030.

The front clip 1600 may also include a pointer 1605. In some aspects, for example, a ruler (such as the ruler 1202) may be disposed on one or both of the front trough 1030 and the bumper 1025. In some aspects, the pointer 1605 may be aligned with one or more tick marks on such a ruler in order to align or help align the partition 1040 at a particular position along a width of the shelving glide 1000.

In operation and/or use, the shelving glide 100 may store, display, and/or support one or more product containers within the pathways 1018. In certain instances, such as when containers of multiple sizes (e.g., widths or otherwise), one or more partitions 1040 may be adjusted along the width of the shelving glide 1000 to, for example, adjust the widths of one or more pathways 1018. In some aspects, the partitions 1040 may be adjusted from a single location, i.e., by a user contacting and applying force to the partition 1040 at one location (e.g., a back end portion, a front end portion, or otherwise). For instance, the user may determine that a particular partition 1040 should be adjusted to increase a width of a particular pathway 1018. The user may grasp the partition 1040 at the back end, such as, for example, by the back clip 1500, and exert an upward force to release the back clip 1500 from the back trough 1050. The user may then rotate the partition 1040 about a pivot located at or proximate the front clip 1600. As the partition 1040 is rotated, the cleats 1610 of the front clip 1600 may be disengaged from corresponding notches 1072 in the front trough 1030. In some aspects, the notches 1072 may be vertical grooves and the shoulder 1615 may allow the front clip 1600 to rotate within the front trough 1030 without removal from the front trough 1030.

Once the front clip 1600 is disengaged from the front trough 1030, the user may adjust the position of the partition 1040 along the width of the shelving glide 1000. Upon a determination that the partition 1040 is at a correct position (e.g., when the pointer 1510 is at a particular tick mark on the ruler 1202), the user may rotate the partition 1040 to reengage the front clip 1600 with the front trough 1030. For example, the cleats 1610 may be inserted into corresponding notches 1072 at the correct position. As the user continues to rotate the partition 1040, the back clip 1500 is reengaged with the back trough 1050 such that the prongs 1515 and 1520 are inserted and/or secured in corresponding grooves 1051. In some aspects, by aligning the pointer 1510 with a particular tick mark on the ruler 1202, the pointer 1605 is aligned with a corresponding tick mark located on the front of the shelving glide 1000, such as on the front trough 1030 and/or the bumper 1025.

A number of embodiments have been described. Nevertheless, it will be understood that various modifications may be made. Accordingly, other embodiments are within the scope of the following claims.

What is claimed is:

1. A shelving glide comprising:

a deck having a plurality of dividers;

a first trough coupled to the deck and comprising a first index arranged along at least a portion of a width of the deck on a surface of the first trough that is substantially perpendicular to the deck, the first index comprising a plurality of notches;

a second trough coupled to the deck and comprising a second index arranged along at least a portion of the width of the deck; and a plurality of partitions coupled to the deck and defining a plurality of pathways, at least one of the plurality of partitions comprising:

a first clip securable to the first index, the first clip comprising a rounded shoulder portion and one or more cleats adapted to be secured within notches of the first index; and a second clip securable to the second index, the partition adjustable along the width of the deck from a first position to a second position different than the first position upon disengagement of the second clip from the second index, wherein the one or more cleats of the first clip are adapted to disengage from the notches of the first index upon disengagement of the second clip from the second index, the rounded shoulder portion adapted to rotate within the first trough and slidingly engage within a recessed portion of the first trough during adjustment of the partition from the first to the second position, the partition secured to the deck at the second position upon reengagement of the second clip to the second index.

2. The shelving glide of claim 1, wherein the first clip is adapted to reengage the first index upon reengagement of the second clip to the second index.

3. The shelving glide of claim 1, the dividers defining a plurality of channels, the shelving glide further comprising a plurality of rollers seated within the channels, the rollers adapted to rotate within the channels and support at least a portion of a container.

4. The shelving glide of claim 3 further comprising a plurality of roller trays removably arranged within the plurality of channels, the plurality of rollers seated on the plurality of roller trays.

5. The shelving glide of claim 4, wherein a portion of the plurality of rollers are seated on one of the plurality of roller trays, the portion of the plurality of rollers and the roller tray defining a ductway adapted to direct a fluid within the deck.

6. The shelving glide of claim 1 further comprising a stage coupled to the deck, the stage adapted to support a plurality of containers.

7. The shelving glide of claim 6, wherein the stage is coupled to the second trough through a flanged connection.

8. The shelving glide of claim 1, wherein the partition is adapted to move along the width of the deck upon sliding movement of the first clip within the recessed portion of the first trough.

9. The shelving glide of claim 1, wherein the notches are disposed substantially vertically within a recessed portion of the first trough.

10. The shelving glide of claim 1, wherein the second index comprises a plurality of grooves, and the second clip comprises one or more prongs extending from the second clip, at least one prong engageable with one of the plurality of grooves in the second index.

11. The shelving glide of claim 1, wherein at least one of the plurality of partitions comprises a flared base portion extending from a substantially vertical wall portion, the flared base portion adapted to extend under at least a portion of a container.

12. The shelving glide of claim 1 further comprising a plurality of container stops, at least one of the container stops attachable to a vertical edge of one of the plurality of partitions, the container stop having a first wing portion extending across a first pathway and a second wing portion extending across a second pathway.

13. The shelving glide of claim 12, wherein the container stop is substantially opaque.

14. A product vessel support device, comprising:

a frame comprising a plurality of channels extending between two opposed edges of the frame, each channel having a plurality of support rollers disposed within the channel, the frame comprising an index formed on a vertical surface coupled to the frame, the index comprising a plurality of notches; and a plurality of vertical divider assemblies detachably secured to the index of the vertical surface coupled to the frame with the plurality of notches, each of the vertical divider assemblies comprising a vertical divider and a rounded shoulder portion, each pair of adjacent vertical dividers defining a corresponding vessel pathway above one or more channels, at least one of the plurality of vertical dividers adjustable along the opposed edges of the frame between a first position and a second position, the rounded shoulder portion adapted to slidingly move between the first and second positions in response to a force applied to the vertical divider at a substantially single location, the rounded shoulder adapted to rotate within the first trough and couple to a deck during sliding movement between the first and second positions.

15. The product vessel support device of claim 14, wherein the vertical divider is secured to the frame adjacent to a front edge by a front clip and secured to the frame adjacent to a back edge by a back clip.

16. The product vessel support device of claim 15, wherein the vertical divider is adapted to slidingly move between the first and second positions upon disengagement of the back clip from the frame and at least partial engagement of the front clip with the frame.

17. The product vessel support device of claim 14, wherein at least one of the plurality of vertical dividers comprises a flared base portion adjacent a portion of the plurality of rollers.

18. The product vessel support device of claim 14, further comprising at least one vessel stop coupled to one of the vertical dividers, the stop having a first wing portion extending across a first vessel pathway and a second wing portion extending across a second vessel pathway adjacent the first vessel pathway.

19. A method for presenting consumer products on a shelving glide that comprises a deck, first and second troughs coupled to the deck, and a partition, the method comprising disengaging a first clip that is coupled to the partition from a first index of the first trough that is arranged on a vertical surface of the first trough along at least a portion of a width of the deck;

based on disengagement of the first clip from the first index, disengaging one or more cleats of a second clip that is coupled to the partition from a first set of notches of a second index of the second trough that is arranged along at least the portion of the width of the deck;

adjusting the partition along the width of the deck from a first position to a second position different from the first position with a rounded shoulder portion of the second clip rotatable within the first trough and slidingly engaged within a recessed portion of the second trough; and reengaging the first clip to the first index.

20. The method of claim 19, wherein disengaging a first clip from a first index comprises lifting a first end of the partition to disengage the first clip from one or more grooves in the first index that are formed on the vertical surface.

21. The method of claim 20, wherein disengaging one or more cleats of a second clip that is coupled to the partition from a first set of notches of a second index of the second trough that is arranged along at least the portion of the width of the deck comprises:

rotating the partition about a fulcrum proximate a second end of the partition to disengage the one or more cleats from the first set of notches of the second index.

22. The method of claim 19, further comprising:

based on reengaging the first clip to the first index, reengaging the one or more cleats of the second clip to a second set of notches of the second index, the second set of notches being different than the first set of notches.

23. The method of claim 19, further comprising inserting at least one product container into a pathway defined between the partition and another partition of the shelving glide.

24. The method of claim 23, wherein inserting at least one product container into a pathway defined between the partition and another partition of the shelving glide comprises:

loading a plurality of product containers on a stage coupled to the deck;

inserting a first product container from the stage into the pathway; and inserting a second product container from the stage into the pathway.

25. The method of claim 19, wherein adjusting the partition along the width of the deck from a first position to a second position different from the first position with the rounded shoulder portion of the second clip slidingly engaged within a recessed portion of the second trough comprises adjusting the partition along the width of the deck from the first position to the second position with human contact of the partition only at or adjacent a first end of the partition.

26. The shelving glide of claim 1, wherein the first clip further comprises a radiussed edge opposite the rounded shoulder portion, and the one or more cleats extend from a face of the first clip that is positioned between the radiussed edge and the rounded shoulder portion, the first clip further comprising a pointer adapted to align the partition at a particular position along a width of the first index.

* * * * *